US009659541B2

(12) United States Patent
Jin et al.

(10) Patent No.: US 9,659,541 B2
(45) Date of Patent: May 23, 2017

(54) DISPLAY PANEL, DISPLAY DEVICE, AND DRIVING METHOD OF DISPLAY DEVICE

(71) Applicants: Shanghai AVIC OPTO Electronics Co., Ltd., Shanghai (CN); Tianma Micro-Electronics Co., Ltd., Shenzhen (CN)

(72) Inventors: Huijun Jin, Shanghai (CN); Zhaokeng Cao, Shanghai (CN); Shoufu Jian, Shanghai (CN); Yao Lin, Shanghai (CN)

(73) Assignees: SHANGHAI AVIC OPTO ELECTRONICS CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 57 days.

(21) Appl. No.: 14/820,517

(22) Filed: Aug. 6, 2015

(65) Prior Publication Data

US 2016/0104442 A1 Apr. 14, 2016

(30) Foreign Application Priority Data

Oct. 10, 2014 (CN) ..... 2014 1 0531216

(51) Int. Cl.
*G09G 5/00* (2006.01)
*G09G 3/36* (2006.01)

(52) U.S. Cl.
CPC ..... *G09G 3/3648* (2013.01); *G09G 3/3614* (2013.01); *G09G 2300/0426* (2013.01); *G09G 2320/0247* (2013.01); *G09G 2330/021* (2013.01)

(58) Field of Classification Search
CPC ..... G09G 3/3648; G09G 3/3614; G09G 2330/021; G09G 2300/0426; G09G 2320/0247
See application file for complete search history.

(56) References Cited

U.S. PATENT DOCUMENTS

2015/0380435 A1* 12/2015 Li ..... G09G 3/3614 349/43

FOREIGN PATENT DOCUMENTS

CN 104090440 A 10/2014
JP 2014041366 A 3/2014

* cited by examiner

*Primary Examiner* — Adam R Giesy
(74) *Attorney, Agent, or Firm* — Faegre Baker Daniels LLP

(57) ABSTRACT

A display panel, a display device and a driving method of the display device, where the display panel includes a pixel structure that includes: in one of two adjacent rows of pixel units, a thin film transistor of a pixel unit in a row electrically connected to a pixel electrode of a pixel unit in the same row adjacently disposed at a first side of the pixel unit; and in the other one of the two adjacent rows of pixel units, a thin film transistor of a pixel unit electrically connected to a pixel electrode of the pixel unit, or electrically connected to a pixel electrode of a pixel unit in the same row adjacently disposed at a second side of the pixel unit; the first side of the thin film transistor being arranged opposite to the second side of the thin film transistor.

13 Claims, 16 Drawing Sheets

| | D1 | D2 | D3 | D4 | D5 | D6 | D7 |
|---|---|---|---|---|---|---|---|
| S1 | + | − | + | − | + | − | |
| S2 | − | + | − | + | − | + | |
| S3 | | | | | | | |
| S4 | | | | | | | |
| S5 | | | | | | | |
| S6 | | | | | | | |
| S7 | | | | | | | |
| | − | + | − | + | − | + | − |

FIG.10B

| | D1 | D2 | D3 | D4 | D5 | D6 | D7 |
|---|---|---|---|---|---|---|---|
| S1 | + | − | + | − | + | − | |
| S2 | − | + | − | + | − | + | |
| S3 | + | − | + | − | + | − | |
| S4 | − | + | − | + | − | + | |
| S5 | + | − | + | − | + | − | |
| S6 | − | + | − | + | − | + | |
| S7 | + | − | + | − | + | − | |
| | − | + | − | + | − | + | − |

FIG.10C

| | D1 | D2 | D3 | D4 | D5 | D6 | D7 |
|---|---|---|---|---|---|---|---|
| S1 | + | − | + | − | + | − | |
| S2 | − | + | − | + | − | + | |
| S3 | + | − | + | − | + | − | |
| S4 | − | + | − | + | − | + | |
| S5 | + | − | + | − | + | − | |
| S6 | − | + | − | + | − | + | |
| S7 | + | − | + | − | + | − | |
| | − | + | − | + | − | + | − |

A first frame of image

FIG.11A

| | D1 | D2 | D3 | D4 | D5 | D6 | D7 |
|---|---|---|---|---|---|---|---|
| S1 | − | + | − | + | − | + | |
| S2 | + | − | + | − | + | − | |
| S3 | − | + | − | + | − | + | |
| S4 | + | − | + | − | + | − | |
| S5 | − | + | − | + | − | + | |
| S6 | + | − | + | − | + | − | |
| S7 | − | + | − | + | − | + | |
| | + | − | + | − | + | − | + |

A second frame of image

FIG.11B

| | D1 | D2 | D3 | D4 | D5 | D6 | D7 |
|---|---|---|---|---|---|---|---|
| S1 | + | − | + | − | + | − | |
| S2 | − | + | − | + | − | + | |
| S3 | + | − | + | − | + | − | |
| S4 | − | + | − | + | − | + | |
| S5 | + | − | + | − | + | − | |
| S6 | − | + | − | + | − | + | |
| S7 | + | − | + | − | + | − | |
| | − | + | − | + | − | + | − |

A first frame of image

FIG.12A

| | D1 | D2 | D3 | D4 | D5 | D6 | D7 |
|---|---|---|---|---|---|---|---|
| S1 | + | − | + | − | + | − | |
| S2 | − | + | − | + | − | + | |
| S3 | + | − | + | − | + | − | |
| S4 | − | + | − | + | − | + | |
| S5 | + | − | + | − | + | − | |
| S6 | − | + | − | + | − | + | |
| S7 | + | − | + | − | + | − | |
| | − | + | − | + | − | + | − |

A second frame of image

FIG.12B

| | D1 | D2 | D3 | D4 | D5 | D6 | D7 |
|---|---|---|---|---|---|---|---|
| S1 | − | + | − | + | − | + | |
| S2 | + | − | + | − | + | − | |
| S3 | − | + | − | + | − | + | |
| S4 | + | − | + | − | + | − | |
| S5 | − | + | − | + | − | + | |
| S6 | + | − | + | − | + | − | |
| S7 | − | + | − | + | − | + | |
| | + | − | + | − | + | − | + |

A third frame of image

FIG.12C

| | D1 | D2 | D3 | D4 | D5 | D6 | D7 |
|---|---|---|---|---|---|---|---|
| S1 | − | + | − | + | − | + | |
| S2 | + | − | + | − | + | − | |
| S3 | − | + | − | + | − | + | |
| S4 | + | − | + | − | + | − | |
| S5 | − | + | − | + | − | + | |
| S6 | + | − | + | − | + | − | |
| S7 | − | + | − | + | − | + | |
| | + | − | + | − | + | − | + |

A fourth frame of image

FIG.12D

DISPLAY PANEL, DISPLAY DEVICE, AND DRIVING METHOD OF DISPLAY DEVICE

CROSS-REFERENCE TO RELATED APPLICATION

This application claims priority to Chinese Application No. 201410531216.0, filed Oct. 10, 2014, which is herein incorporated by reference in its entirety.

TECHNICAL FIELD

The present application relates to a field of display technologies, in particular, to a display panel, a display device, and a driving method of the display device.

BACKGROUND

With the development of display technologies, Liquid Crystal Display (LCD) devices have been widely used, and the display effect of the LCD devices is improved continuously.

Generally in the LCD device, the polarity of a voltage difference applied to liquid crystal molecules must be inverted periodically, to prevent the liquid crystal material from being destroyed permanently due to the polarization of the liquid crystal material, and further avoid the residual image effect. The usual polarity inversion methods include a frame inversion method, a dot inversion method, a column inversion method, a row inversion method, a double-column inversion method, and a double-dot inversion method. Among the above inversion methods, the frame inversion method is advantageous for the minimum power consumption but is susceptible to a flicker phenomenon; the dot inversion method is disadvantageous for the maximum power consumption but has the best display effect; and the column inversion method, the row inversion method, the double-column inversion method, and the double-dot inversion method cause power consumption between the power consumption of the dot inversion method and the power consumption of the frame inversion method.

Based on the characteristics of the above inversion methods, column inversion or row inversion is generally used to implement the dot inversion method in the related art, in order to reduce the power consumption caused by the polarity inversion. FIG. 1 is a schematic structure diagram of a pixel structure in the related art. As shown in FIG. 1, the pixel structure, in which the dot inversion is implemented by the column inversion, includes a plurality of data lines 11, a plurality of scan lines 12, a plurality of pixel units 13 formed by intersecting the plurality of data lines 11 with the plurality of scan lines 12, and a thin film transistor 14 and a pixel electrode 15 located in each of the pixel units 13. A gate electrode of each thin film transistor 14 is electrically connected to the scan line 12 below the thin film transistor 14, and a drain electrode of each thin film transistors 14 is electrically connected to the pixel electrode 15 of the pixel unit 13 including thin film transistor 14. For any two adjacent rows of the pixel units 13, the source electrodes of the thin film transistors 14 from one of the two adjacent rows of the pixel units 13 are electrically connected to the data lines 11 on the left thereof, and the source electrodes of the thin film transistors 14 from the other one of the two adjacent rows of the pixel units 13 are electrically connected to the data lines 11 on the right thereof, that is, the thin film transistors 14 from the odd rows of pixel units 13 and the thin film transistors 14 from the even rows of pixel units 13 are connected to the data lines 11 on different sides, respectively.

However, for the above described pixel structure, if the source electrode and drain electrode of a thin film transistor 14 are not precisely aligned relative to the gate electrode of the thin film transistor 14 during manufacturing the thin film transistor 14, for example, the source electrode and drain electrode deflect to the left or right relative to the desired positions, then an overlapped area between the drain electrode and the gate electrode of a thin film transistor 14 from the odd row is unequal to an overlapped area between the drain electrode and the gate electrode of a thin film transistor 14 from the even row, so that the capacitance formed by the drain electrode and the gate electrode of the thin film transistor 14 from the odd row is unequal to the capacitance formed by the drain electrode and the gate electrode of the thin film transistor 14 from the even row, as a result, when scan signals applied by the scan lines 11 are pulled down, voltages of the pixel electrodes 15 from the odd row are pulled down to a different degree as compared with voltages of the pixel electrodes 15 from the even row, and accordingly, the common electrode compensating voltage required for the pixel electrode 15 from the odd row is different from that required for the pixel electrode 15 from the even row. Because the common electrode is planar, i.e., the common electrode located above different pixel electrodes 15 is applied with the same common voltage, the common electrode cannot completely compensate for the voltages of the pixel electrodes 15 from the odd rows or from the even rows, thereby generating transverse striations and the flicker in the pixel structure.

SUMMARY

Embodiments of the present disclosure provide a display panel, a display device and a driving method of the display device, in order to avoid the transverse striations and the flicker in the pixel structure generated due to the imprecise position alignment of the thin film transistor in the pixel structure where the dot inversion is achieved by the column inversion in the related art.

In a first aspect, embodiments of the disclosure provide a display panel, and the display panel includes a pixel structure, the pixel structure including:

a plurality of data lines and a plurality of scan lines; and a plurality of pixel units formed by intersecting the plurality of data lines with the plurality of scan lines, where a pixel unit corresponds to one of the plurality of data lines and one of the plurality of scan lines;

and each of the pixel units comprises a pixel electrode and a thin film transistor therein;

where in one of two adjacent rows of pixel units, the thin film transistor of a pixel unit in a row is electrically connected to a pixel electrode of a pixel unit in the same row adjacently disposed at a first side of the pixel unit comprising the thin film transistor; and in the other one of the two adjacent rows of pixel units, a thin film transistor of a pixel unit in a row is electrically connected to a pixel electrode of the pixel unit, or the thin film transistor of the pixel unit in the row is electrically connected to a pixel electrode of a pixel unit in the same row adjacently disposed at a second side of the pixel unit comprising the thin film transistor;

and the first side of the thin film transistor is arranged opposite to the second side of the thin film transistor.

In a second aspect, embodiments of the disclosure provide an array substrate including the pixel structure of the first example mentioned above.

In a third aspect, embodiments of the disclosure provide a display device including the display panel of the first example mentioned above.

In a fourth aspect, embodiments of the disclosure provide a driving method of the display device, the driving method is carried out by the display device of the fourth example, including:

pixel units controlled by each scan line are sequentially turned on by the corresponding scan lines, wherein the pixel unit comprises a pixel electrode and a thin film transistor, and in one of two adjacent rows of pixel units, a thin film transistor of a pixel unit in a row is electrically connected to a pixel electrode of a pixel unit in the same row adjacently disposed at a first side of the pixel unit comprising the thin film transistor, and in the other one of the two adjacent rows of pixel units, a thin film transistor of a pixel unit in a row is electrically connected to a pixel electrode of the pixel unit, or a thin film transistor of a pixel unit in a row is electrically connected to a pixel electrode of a pixel unit in the same row adjacently disposed at a second side of the pixel unit comprising the thin film transistor; and the first side of the thin film transistor is arranged opposite to the second side of the thin film transistor;

applying first data signals to the turned-on pixel units by odd groups of data lines, applying second data signals to the turned-on pixel units by even groups of data lines, wherein the polarity of the second data signal is inverse to the polarity of the first data signal; and each group of data lines comprises at least one data line.

According to the pixel structure, array substrate, display panel, display device, and driving method of the display, in at least some embodiments of the disclosure, in one of two adjacent rows of pixel units, the thin film transistor of each pixel unit is electrically connected to the pixel electrode of a pixel unit adjacently located at a first side of the thin film transistor; and in the other one of the two adjacent rows of pixel units, the thin film transistor of each pixel unit is electrically connected to the pixel electrode of the pixel unit, or the thin film transistor of each pixel unit in a column is electrically connected to the pixel electrode of a pixel unit adjacently located at a second side of the thin film transistor, thus the pixel structure can achieve a dot inversion by a column inversion or can achieve two dot inversion by double-column inversion, thereby ensuring the small power consumption of the polarity inversion. Also, even if the source electrode and drain electrode are not precisely aligned with the gate electrode during the manufacturing of the thin film transistor, the lowered degree of the voltage of the pixel electrodes of the odd rows are the same as that of the pixel electrodes of the even rows when the scan signals applied by the scan lines are lowered, accordingly, the compensate voltage of the common electrode required by the pixel electrodes of the odd rows is equal to that required by the pixel electrodes of the even rows, namely the common electrode can completely compensate the voltage of the pixel electrodes of the odd rows and the even rows, so that the stripes or flicker generated because the common electrode cannot completely compensate the voltage of the pixel electrode of the odd rows and the even rows can be avoided, and thus improving the display effect of the pixel structure.

While multiple embodiments are disclosed, still other embodiments of the disclosure will become apparent to those skilled in the art from the following detailed description, which shows and describes illustrative embodiments of the disclosure. Accordingly, the drawings and detailed description are to be regarded as illustrative in nature and not restrictive.

BRIEF DESCRIPTION OF THE DRAWINGS

Other features, objects and advantages of the disclosure will become apparent from the following detailed description made to embodiments with reference to the accompanying drawings below, in which:

FIGS. 10A to 10C are schematic diagrams of polarity inversion corresponding to steps for achieving the dot inversion by the column inversion, according to embodiments of the disclosure;

FIGS. 11A to 11B are schematic diagrams of the polarity inversion of the display device, according to embodiments of the disclosure; and FIGS. 12A to 12D are schematic diagrams of the polarity inversion of another display device, according to embodiments of the disclosure.

Figure 1:
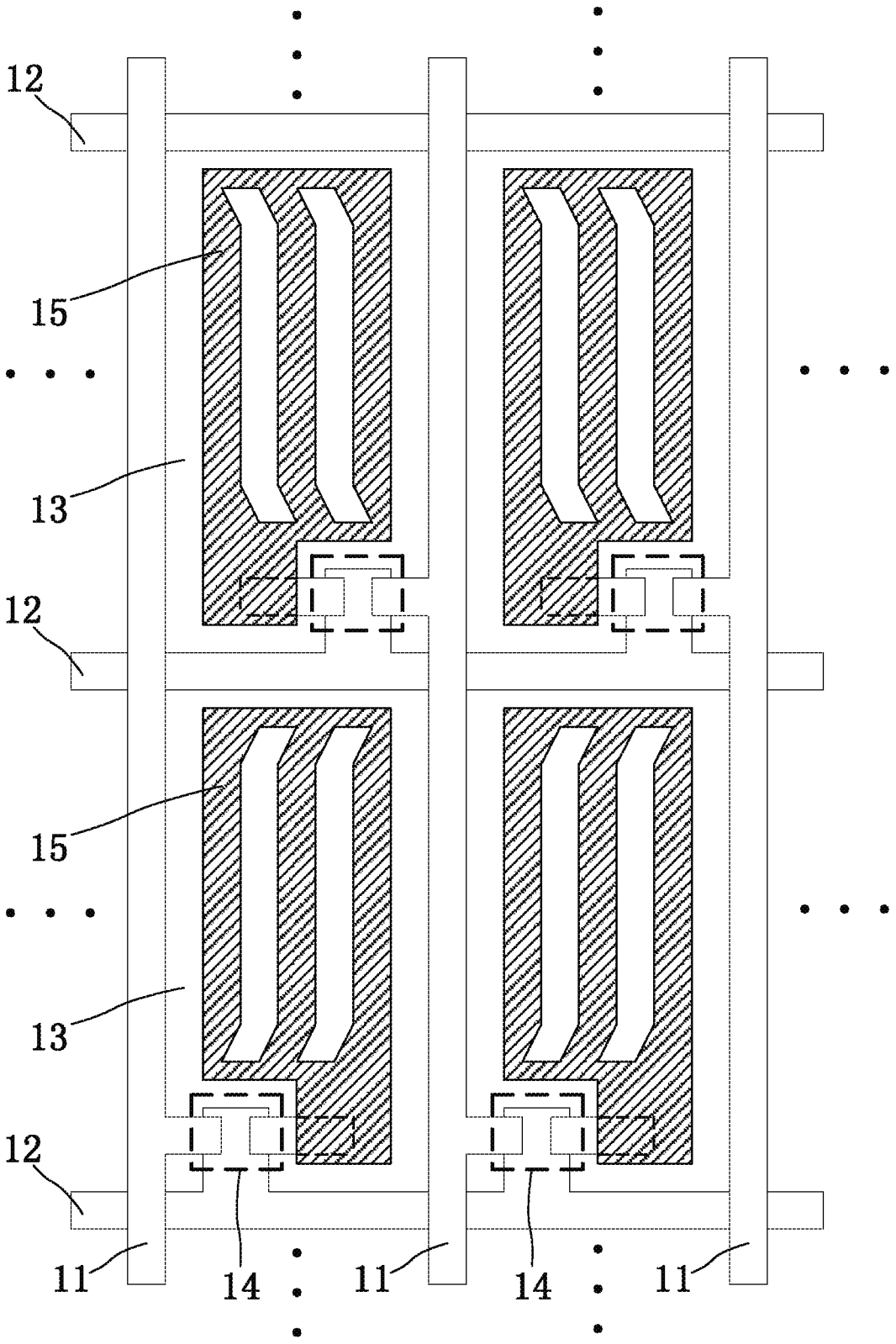
FIG. 1 is a schematic diagram of the structure of a pixel structure in the related art.

While the disclosure is amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives falling within the scope of the disclosure as defined by the appended claims.

DETAILED DESCRIPTION

The present disclosure will be further illustrated in detail below in conjunction with the accompanying drawings and embodiments. It may be understood that specific embodiments described herein are merely for explaining the disclosure rather than limiting the disclosure. Additionally, it is noted that merely partial contents associated with the disclosure rather than all contents are illustrated in the accompanying drawings for ease of description.

Figure 2A:
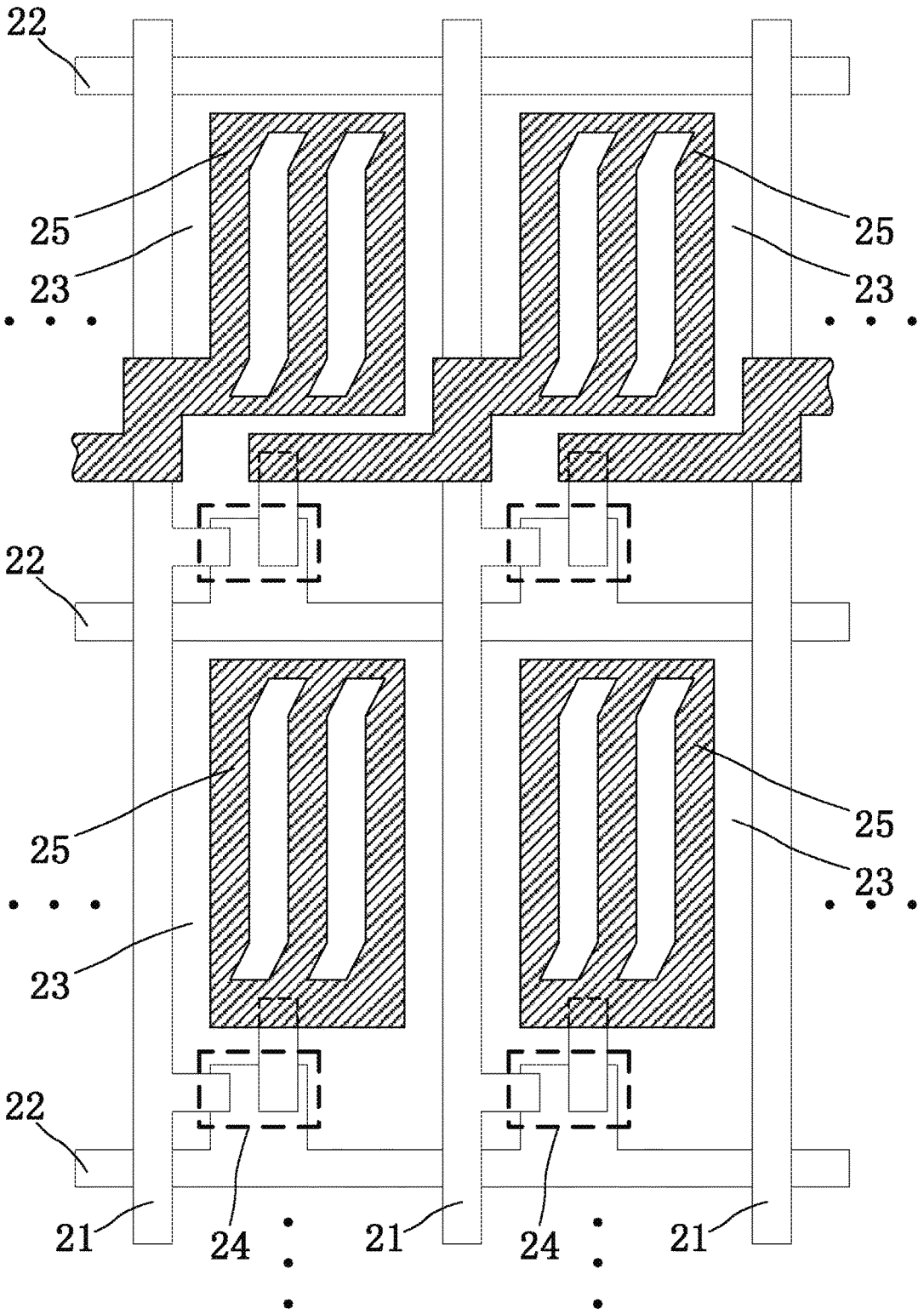
FIG. 2A is a schematic diagram of the structure of a pixel structure, according to embodiments of the disclosure.

Embodiments of the disclosure provide a pixel structure. FIG. 2A is a schematic diagram of the structure of a pixel structure, according to embodiments of the disclosure. As shown in FIG. 2A, the pixel structure includes a plurality of data lines 21, a plurality of scan lines 22, and a plurality of pixel units 23 formed by intersecting the plurality of data lines 21 with the plurality of scan lines 22, where a pixel unit 23 corresponds to one of the plurality of data lines 21 and one of the plurality of scan lines 21; each of the pixel units 23 includes a pixel electrode 25 and a thin film transistor 24 therein; wherein in one of two adjacent rows of pixel units 23, such as an odd row of pixel units 23 in FIG. 2A, a thin film transistor 24 of a pixel unit 23 in a row is electrically connected to a pixel electrode 25 of a pixel unit in the same row adjacently disposed at a first side (such as the right side in FIG. 2A) of the pixel unit comprising the thin film transistor 24; and in the other one of the two adjacent rows of pixel units 23, such as an even row in FIG. 2A, a thin film transistor 24 of a pixel unit 23 in a row is electrically connected to a pixel electrode 25 of the pixel unit 23.

It should be noted that the display of the pixel unit is implemented by the pixel electrode of the pixel unit and the thin film transistor electrically connected to and configured for controlling the pixel electrode. The thin film transistor controls the pixel electrode, and hence controls the pixel unit including the pixel electrode. The scan line electrically connected to the gate electrode of the thin film transistor can turn on or turn off the thin film transistor. The scan line electrically connected to the source electrode of the thin film transistor can provide a data signal for the pixel electrode electrically connected to the thin film transistor when the thin film transistor is turned on. Based on this, each of such pixel units 23 corresponds to one of the data lines 21 and one of the scan lines 22. The data line 21 corresponding to the pixel unit 23 is the one electrically connected to the thin film transistor 24 for controlling the pixel unit 23; and the scan line 22 corresponding to the pixel unit 23 is the one electrically connected to the thin film transistor 24 for controlling the pixel unit 23.

Figure 2B:
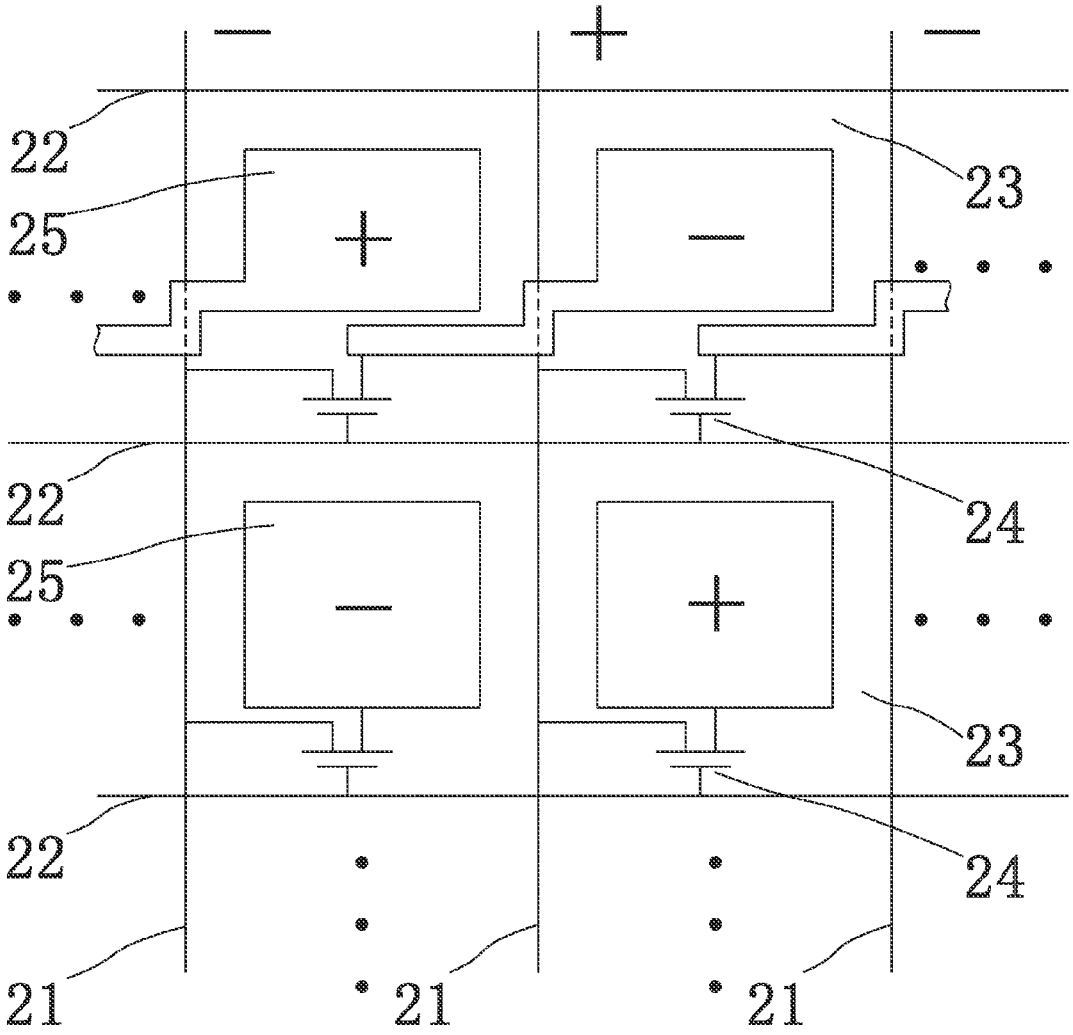
FIG. 2B is a schematic diagram of the structure of the pixel structure which achieves dot inversion by column inversion corresponding to FIG. 2A.

If the polarity disclosure in the above pixel structure is implemented by column inversion, as shown in FIG. 2B, polarities of the data signals applied to the pixel units 23 controlled by any two adjacent scan lines 22 (corresponding to two adjacent columns of pixel units) are inverse to each other. The polarity of the data signal is determined by a voltage difference between the voltage of the data signal and the common voltage. If the voltage difference is greater than 0, the polarity of the data signal is positive and indicated by "+" in FIG. 2B; and if the voltage difference is less than 0, the polarity of the data signal is negative and indicated by "−" in FIG. 2B. In FIG. 2B, in one of two adjacent rows of pixel units, such as an odd row of pixel units in FIG. 2B, a thin film transistor 24 of each pixel unit 23 in a column is electrically connected to a pixel electrode 25 of a pixel unit 23 adjacently disposed at a first side (such as right side in FIG. 2B) of the thin film transistor 24, and in other one of the two adjacent rows of pixel units 23, such as an even row of pixel units in FIG. 2B, a thin film transistor 24 of each pixel unit 23 is electrically connected to a pixel electrode 25 of the pixel unit 23. Therefore, in a column of pixel units 23, the data line 21 at a first side of a pixel unit 23 from each even row of pixel units provides a data signal for the pixel unit 23, and the data line 21 at a second side of a pixel unit 23 from each odd row of pixel units 23 provides a data signal for the pixel unit 23. That is, in a column of pixel units 23, the polarity of the data signal obtained by a pixel unit 23 from the odd row of pixel units is inverse to the polarity of the data signal obtained by a pixel unit 23 from the even row of pixel units, and in a row of pixel units, the polarity of the data signal obtained by a pixel unit 23 from one of two adjacent columns of pixel units is inverse to the polarity of the data signal obtained by a pixel unit 23 from the other one of two adjacent columns of pixel units. As described above, the pixel structure shown in FIG. 2A may achieve a dot inversion by a column inversion, thereby enabling the small power consumption of the polarity inversion similarly to the related art. It should be noted that in the above-mentioned polarity inversion, two frames of images may be used as a polarity inversion driving period, and alternatively, four frames of images or more even-numbered frames of images may also be used as a polarity inversion driving period. Preferably, two frames of images are used as a polarity inversion driving period.

Additionally, since each of the thin film transistors 24 is electrically connected to the data lines located in the same side of the thin film transistors 24 (for example, the left side shown in FIG. 2A), even if the source electrode and drain electrode of the thin film transistor 24 are not precisely positioned relative to the gate electrode during manufacturing the thin film transistor 24, the overlapped area between the drain electrode and the gate electrode of the thin film transistor 24 from the odd rows of thin film transistors 24 is equal to the overlapped area between the drain electrode and the gate electrode of the thin film transistor 24 from the even rows of thin film transistors 24, so that the capacitance formed by the drain electrode and the gate electrode of the thin film transistors 24 from the odd rows of thin film transistors 24 is equal to the capacitance formed by the drain electrode and the gate electrode of the thin film transistor 24 from the even rows of the thin film transistors 24. In such cases, when the scanning signals applied by the scan lines 22 are pulled down, the voltages of the pixel electrodes 25 from the odd rows of pixel units are pulled down to the same degree as the voltages of the pixel electrodes 25 from the even rows of pixel units, and accordingly, the common electrode compensating voltage required for the pixel electrode 25 from the odd rows is equal to that required for the pixel electrode 25 from the even rows. Since the voltages of the pixel electrodes 25 from both the odd rows and the even rows can be completely compensated by a common electrode when compared with the related art, transverse striations and the flicker generated due to incomplete compensation by the common electrode for the voltages of the pixel electrodes 25 from the odd rows and from the even rows can be avoided, and thus improving the display effect of the pixel structure.

In FIG. 2A, in an odd row of pixel units, a thin film transistor 24 of a pixel unit 23 in a row is electrically connected to a pixel electrode 25 of a pixel unit 23 in the same row adjacently located at the right side of the pixel unit 23 comprising the thin film transistor 24; and in an even row of pixel units, a thin film transistor 24 of a pixel unit 23 in a row is electrically connected to a pixel electrode 25 of the pixel unit. Additionally, in the pixel structure as shown in FIG. 2C, it is also possible that in an odd row of pixel units, a thin film transistor 24 of each pixel unit 23 in a column is electrically connected to a pixel electrode 25 of a pixel unit adjacently located at a left side of the thin film transistor 24; and in an even row of pixel units, a thin film transistor 24 of each pixel unit 23 is electrically connected to a pixel electrode 25 of the pixel unit, so that the pixel structure may achieve a dot inversion by a column inversion, specifically as shown in FIG. 2B, which is not described in detail herein.

Figure 2C:
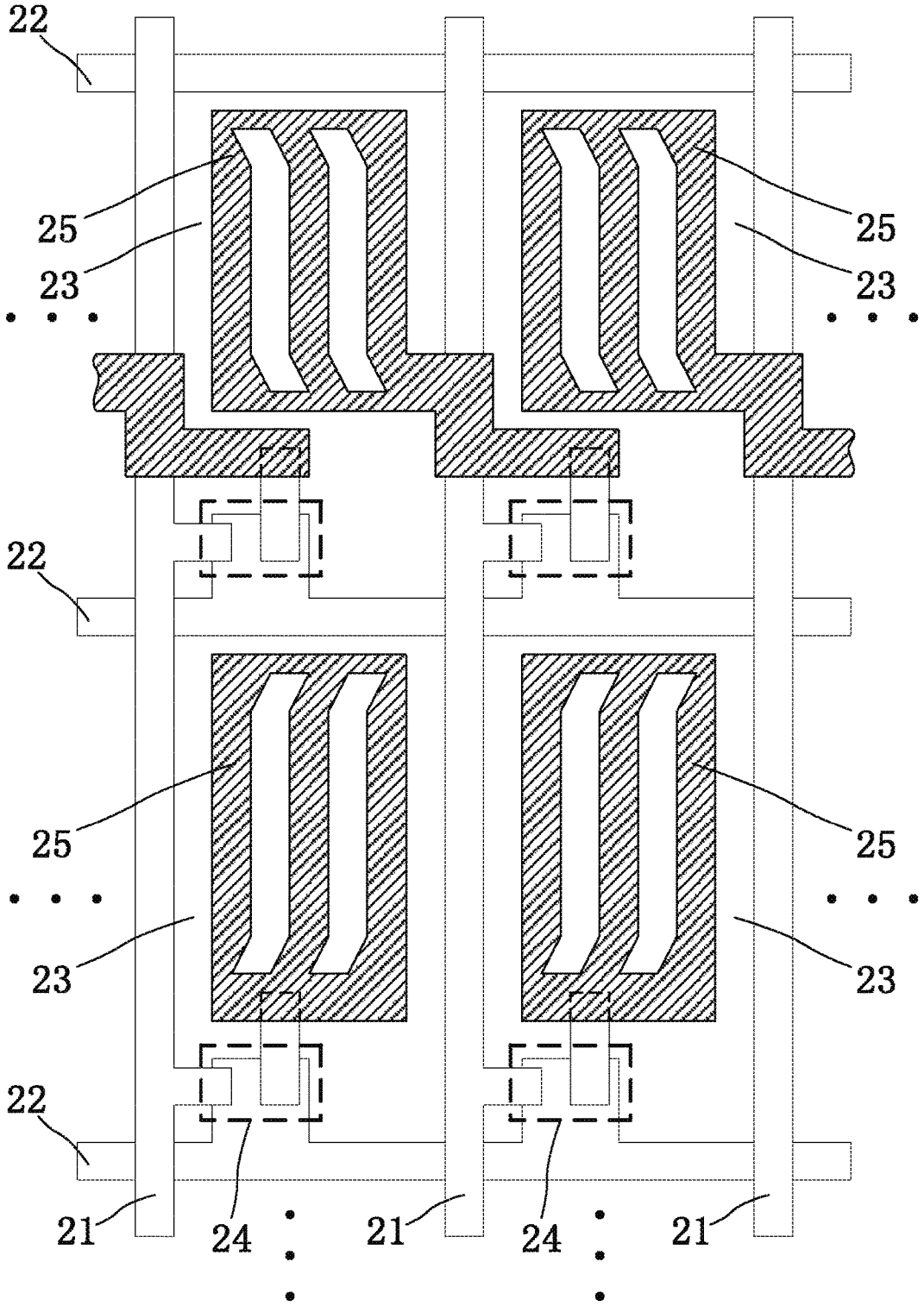
FIG. 2C is a schematic diagram of the structure of another pixel structure, according to embodiments of the disclosure.
Figure 3A:
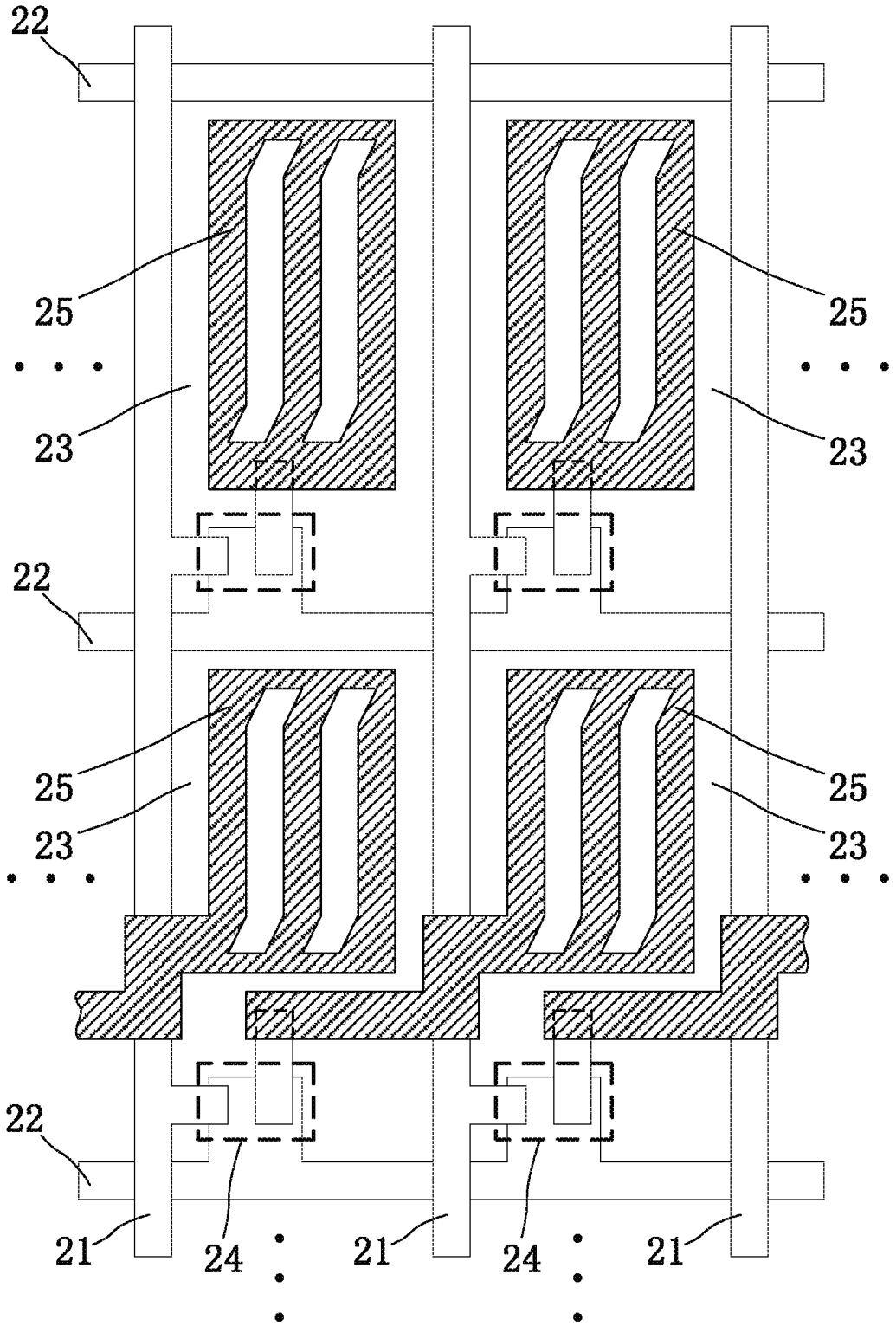
FIG. 3A is a schematic diagram of the structure of further pixel structure, according to embodiments of the disclosure.
Figure 3B:
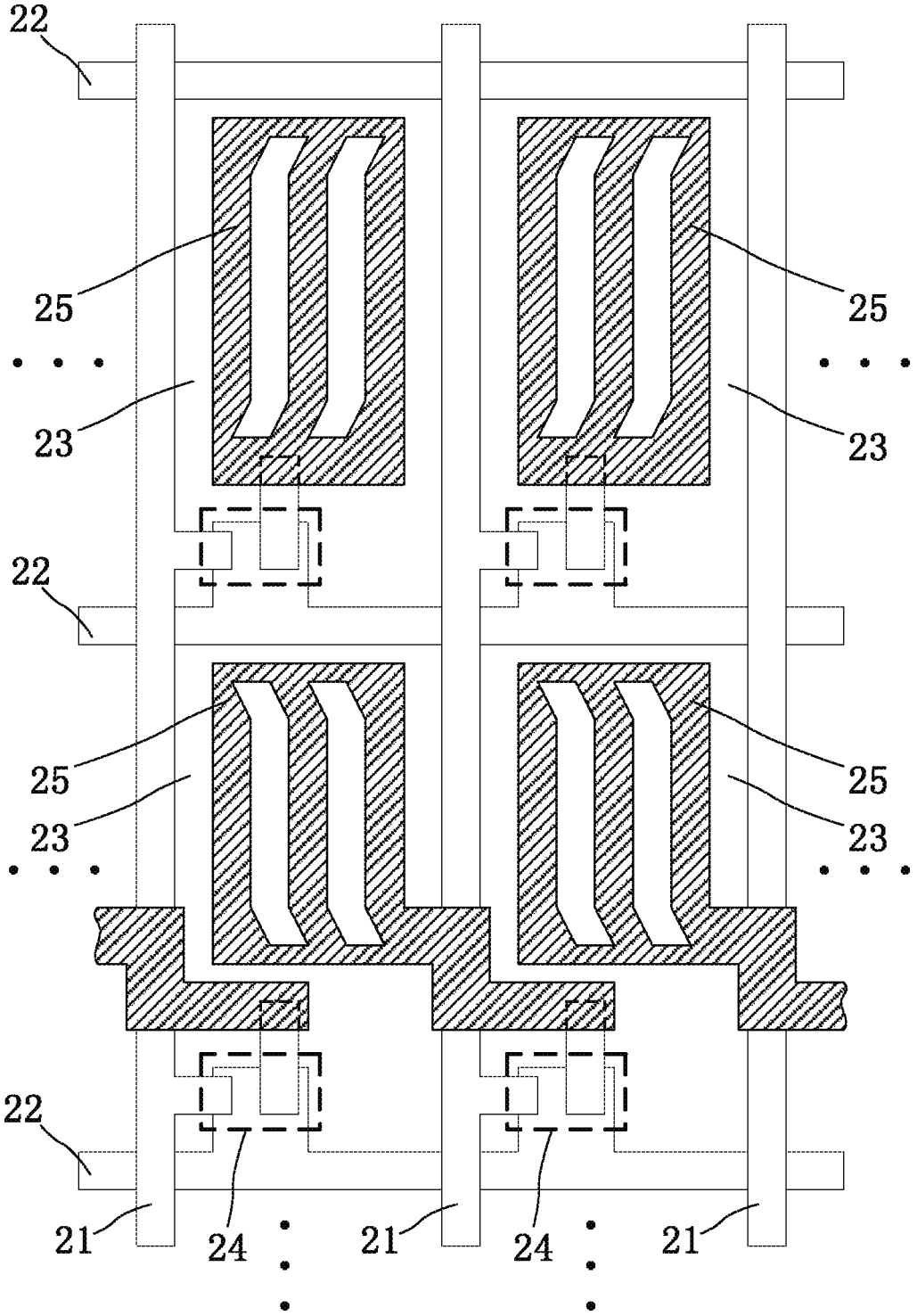
FIG. 3B is a schematic diagram of the structure of yet another pixel structure, according to embodiments of the disclosure.

In addition to the pixel structures shown in FIGS. 2A and 2C, in an embodiment of the present disclosure, referring to in FIG. 3A, it is also possible in the pixel structure that in an even row of pixel units, a thin film transistor 24 of each pixel unit 23 in a column is electrically connected to a pixel electrode of a pixel unit adjacently located at a right side of the thin film transistor 24, and in an odd row of pixel units, a thin film transistor 24 of each pixel unit 23 is electrically connected to a pixel electrode 25 of the pixel unit 23; or alternatively referring to FIG. 3B, it is also possible in the pixel structure that in an even row of pixel units, a thin film transistor 24 of each pixel unit 23 in a column is electrically connected to a pixel electrode 25 of a pixel unit adjacently located at a left side of the thin film transistor 24, and in an odd row of pixel units, a thin film transistor 24 of each pixel unit 23 is electrically connected to a pixel electrode 25 of the pixel unit 23. It should be noted that the pixel structures in FIGS. 3A and 3B may likewise achieve a dot inversion by a column inversion, specifically as shown in FIG. 2B, which is not described in detail herein.

According to embodiments of the disclosure, in the pixel structure in which a dot inversion is achieved by a column inversion, the transverse striations and the flicker generated due to incorrect positions of the source electrode and drain electrode relative to the gate electrode during manufacturing the thin film transistor can be avoided while ensuring the relatively small power consumption of the polarity inversion. Additionally, the similar effect can be obtained on the pixel structure in which two-dots inversion are achieved by two-columns inversion, and related embodiments will be described as below.

Figure 4A:
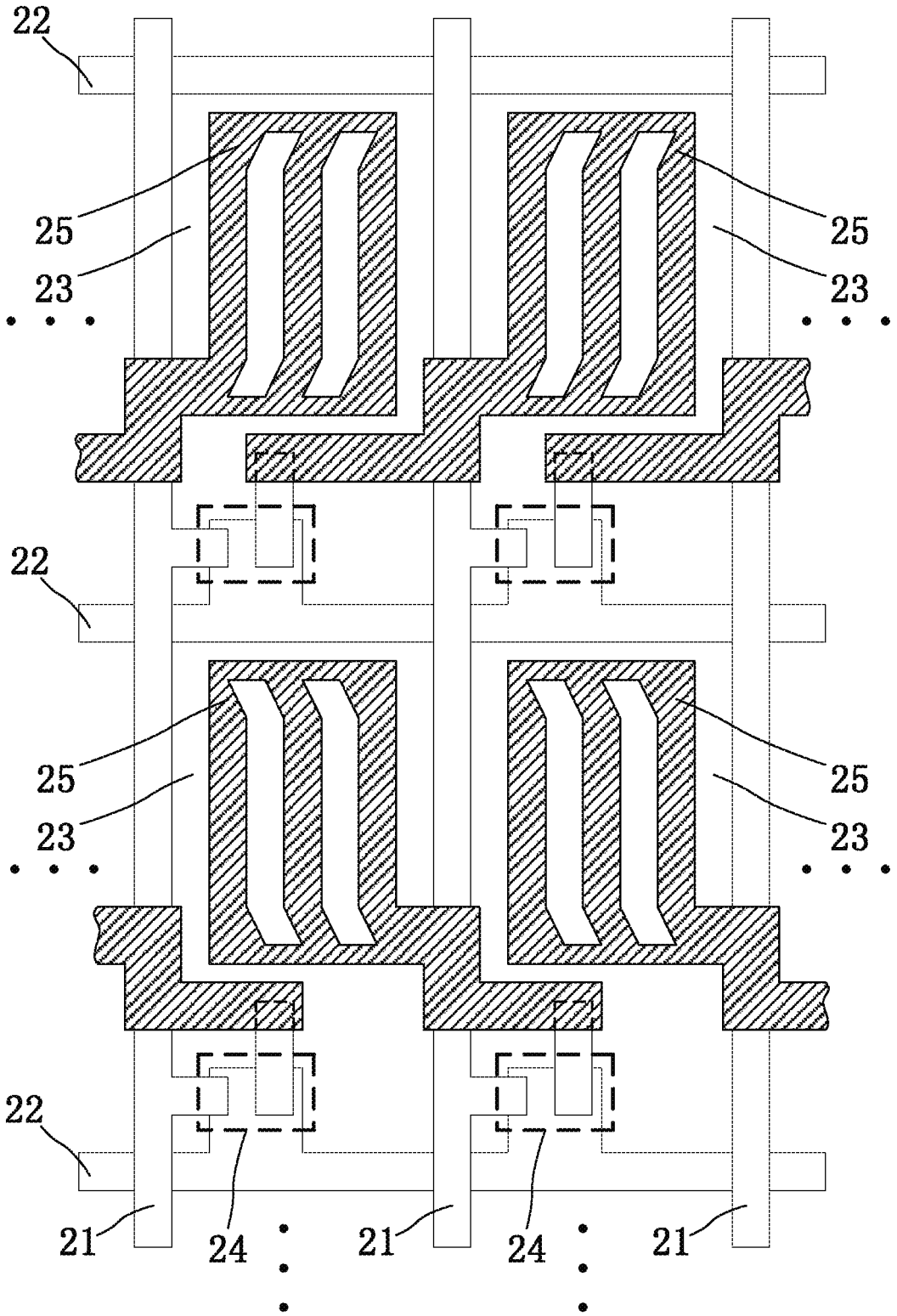
FIG. 4A is a schematic diagram of the structure of yet another pixel structure, according to embodiments of the disclosure.

Referring to FIG. 4A, in an odd row of pixel units, a thin film transistor 24 of each pixel unit 23 in a column is electrically connected to a pixel electrode of a pixel unit adjacently located at a first side (i.e. the right side in FIG. 4A) of the thin film transistor 24; and in an even row of pixel units, a thin film transistor of each pixel unit 23 in a column is electrically connected to a pixel electrode of a pixel unit adjacently located at a second side (i.e. the left side in FIG. 4A) of the thin film transistor 24, where an adjacent column at the first side of the thin film transistor 24 is arranged opposite to an adjacent column at the second side of the thin film transistor 24.

Figure 4B:
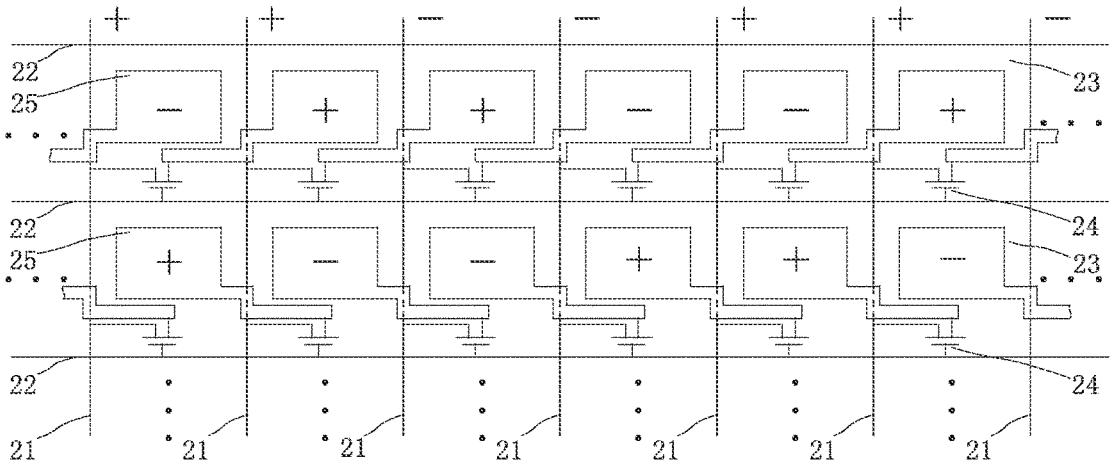
FIG. 4B is a schematic diagram of the structure of the pixel structure which achieves two dots inversion by double-columns inversion corresponding to FIG. 4A.

If the polarity inversion is achieved by two-column inversion in the pixel structure in FIG. 4A, two adjacent data lines are defined as a group of data lines for providing data signals with the same polarities, and two adjacent groups of data lines provides data signals with inverse polarities, as shown in FIG. 4B. In FIG. 4B, in an odd row of pixel units, a thin film transistor 24 of each pixel unit 23 in a column is electrically connected to a pixel electrode 25 of a pixel unit adjacently located at a first side (i.e. the right side in FIG. 4B) of the thin film transistor 24, and in an even row of pixel units, a thin film transistor 24 of each pixel unit 23 in a column is electrically connected to a pixel electrode 25 of a pixel unit adjacently located at a second side (i.e. the left side in FIG. 4B) of the thin film transistor 24, in this case, with respect to three data lines which respectively provide data signals with polarities of "+", "−" and "−" among seven data lines sequentially arranged from left side to right side as shown in FIG. 4B (in which the omitted data lines are not considered), in each of two columns of pixel units among such three data lines, the data line 21 disposed adjacently at the left side of a pixel unit 23 from an odd row of pixel units provides a data signal with polarity of "+" to the pixel unit 23, and the data line 23 disposed adjacently at the right side of a pixel unit 23 from an even row of pixel units provides a data signal with polarity of "−" to the pixel unit 23; that is, in the above two adjacent columns of pixel units, the polarity of the data signal obtained by a pixel unit 23 from each odd row of pixel units is inverse to that of the data signal obtained by a pixel unit 23 from each even row of pixel units. Likewise, with respect to three data lines which respectively provide data signals with polarities of "−", "+" and "+" among seven data lines sequentially arranged from left side to right side as shown in FIG. 4B, in each of two columns of pixel units among such three data lines, a data signal with polarity of "−" is provided to the pixel unit 23 in each of odd rows of pixel units, and a data signal with polarity of "+" is provided to the pixel unit 23 in each of even rows of pixel units. As described above, the pixel structure in FIG. 4A can achieve two dot inversion by double-column inversion, thereby enabling the small power consumption of the polarity inversion similarly to the related art. It should be noted that in the above-mentioned polarity inversion, two frames of images may be used as a polarity inversion driving period, and alternatively, four frames of images or more even-numbered frames of images may also be used as a polarity inversion driving period. Preferably, two frames of images are used as a polarity inversion driving period.

Additionally, since each of the thin film transistors 24 is electrically connected to the data lines located in the same side of the thin film transistors 24 (for example, the left side shown in FIG. 4A), even if the source electrode and drain electrode of the thin film transistor 24 are not precisely positioned relative to the gate electrode during manufacturing the thin film transistor 24, the overlapped area between the drain electrode and the gate electrode of the thin film transistor 24 from the odd rows of thin film transistors 24 is equal to the overlapped area between the drain electrode and the gate electrode of the thin film transistor 24 from the even rows of thin film transistors 24, so that the capacitance formed by the drain electrode and the gate electrode of the thin film transistors 24 from the odd rows of thin film transistors 24 is equal to the capacitance formed by the drain electrode and the gate electrode of the thin film transistor 24 from the even rows of the thin film transistors 24. In such cases, when the scanning signals applied by the scan lines 22 are pulled down, the voltages of the pixel electrodes 25 from the odd rows of pixel units are pulled down to the same degree as the voltages of the pixel electrodes 25 from the even rows of pixel units, and accordingly, the common electrode compensating voltage required for the pixel electrode 25 from the odd rows is equal to that required for the pixel electrode 25 from the even rows. Since the voltages of the pixel electrodes 25 from both the odd rows and the even rows can be completely compensated by a common electrode when compared with the related art, transverse striations and the flicker generated due to incomplete compensation by the common electrode for the voltages of the pixel electrodes 25 from the odd rows and from the even rows can be avoided, and thus improving the display effect of the pixel structure.

Figure 4C:
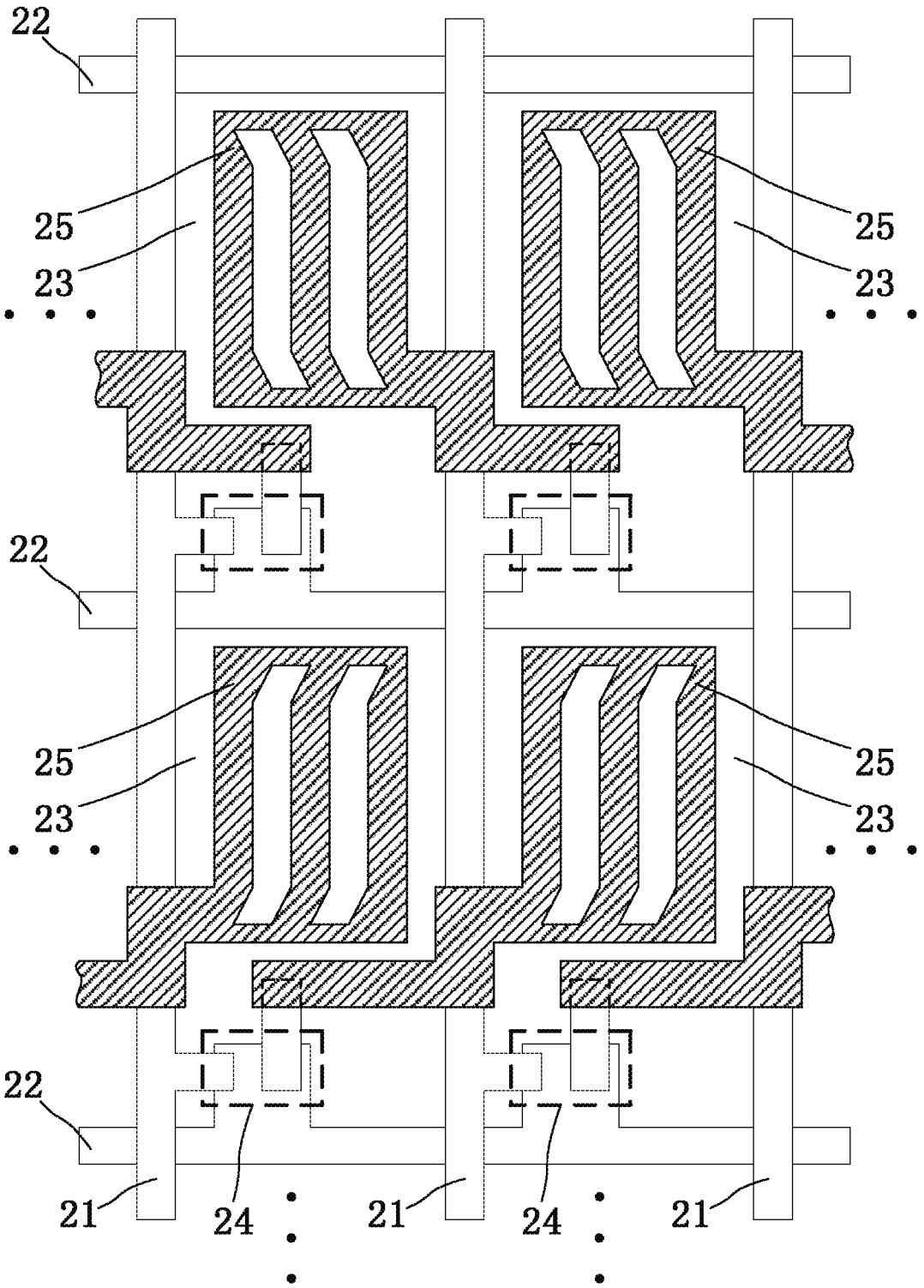
FIG. 4C is a schematic diagram of the structure of yet another pixel structure, according to embodiments of the disclosure.

FIG. 4A shows just a specific example for the pixel structure in which two-dot inversion is achieved by two-column inversion. In another example, as shown in FIG. 4C, it is possible in the pixel structure that in an even row of pixel units, a thin film transistor 24 of each pixel unit 23 in a column is electrically connected to a pixel electrode of a pixel unit adjacently located at a right side of the thin film transistor 24; and in an odd row of pixel units, a thin film transistor 24 of each pixel unit 23 in a column is electrically connected to a pixel electrode of a pixel unit adjacently located at a left side of the thin film transistor 24.

In embodiments of the disclosure, the source electrode of the thin film transistor is electrically connected to the data line corresponding to the pixel unit including the pixel electrode electrically connected to the thin film transistor; and a gate electrode of the thin film transistor is electrically connected to the scan line corresponding to the pixel unit including the pixel electrode electrically connected to the thin film transistor. For example, as shown in FIG. 2A, the gate electrode of each of the thin film transistors 24 is electrically connected to the scan line 22 adjacently located below the thin film transistor 24, that is, the scan line 22 corresponding to the pixel unit 23 is adjacently located below the pixel unit 23; the source electrode of the thin film transistor 24 is electrically connected to the data line 21 adjacently located at the left side of the pixel unit 23 including the thin film transistor 24. In an odd row of pixel units, the data line 21 corresponds to a pixel unit 23 adjacently located at the right side of the thin film transistor 24 electrically connected to said data line 21, and is configured to provide a data signal to the pixel unit 23; in an even row of pixel units, the data line 21 corresponds to a pixel unit 23 including the thin film transistor 24 electrically connected to said data line 21, and is configured to provide a data signal to the pixel unit 23. The description for the connection ways between the thin film transistors 24 and the data lines 21 and between the thin film transistors 24 and the scan lines 22 in FIGS. 2C, 3A, 3B, 4A and 4C, can be referred to the above-mentioned related description for FIG. 2A, and will not be described repeatedly herein.

In the above embodiments, it merely shows that each of the thin film transistors 24 is electrically connected to the data line 21 adjacently located at the left side of the thin film transistor 24. However, it is also possible that each of the thin film transistors 24 is electrically connected to the data line 21 adjacently located at the right side of the thin film transistor 24, which is not limited thereto.

In the above embodiments, the pixel units 23 in the pixel structure are arranged as a matrix. Alternatively, the pixel units 23 may also be arranged in a staggered way. The description for the case that a dot inversion is achieved by a column inversion or two-dot inversion is achieved by two-column inversion in the pixel structure formed by the pixel unit 23 arranged in a staggered way can be referred to FIGS. 2A to 2C, 3A, 3B and 4A to 4C and the related description thereof, which will not be described repeatedly herein.

Further, referring to FIGS. 2A, 3A, 4A and 4C, in the same row, the pixel electrode 25, which is electrically connected to the thin film transistor 24 of a pixel unit 23 adjacently located at the left side of the pixel electrode 25, partially overlaps with the data line 21 adjacently located at the left side of the pixel electrode 25; or referring to FIGS. 2C, 3B, 4A and 4C, in the same row, the pixel electrode 25, which is electrically connected to the thin film transistor 24 of a pixel unit 23 adjacently located at the right side of the pixel electrode 25, partially intersects with the data line 21 adjacently located at the right side of the pixel electrode 25.

Figure 5A:
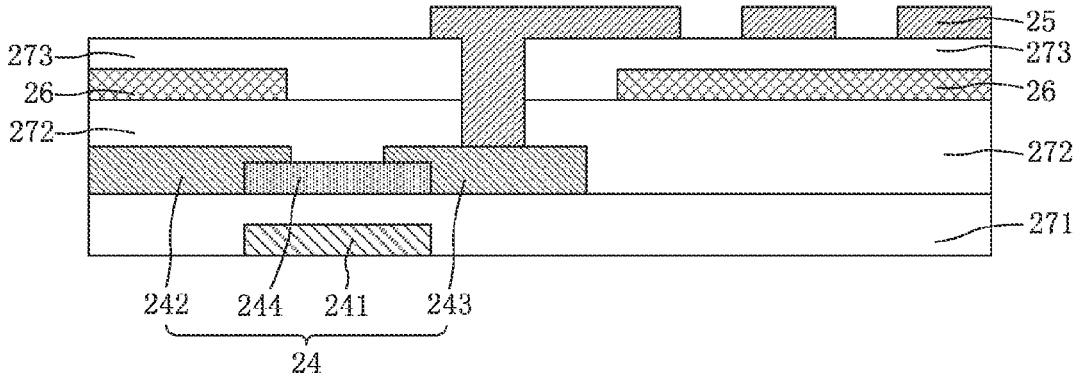
FIG. 5A is a schematic diagram of the structure of yet another pixel structure, according to embodiments of the disclosure.

Based on the pixel structure described above, in some embodiments, a pixel structure includes a common electrode 26 as shown in FIG. 5A. The common electrode 26 is located between the pixel electrode 25 and a film layer where the source electrode 242 and the drain electrode 243 of the thin film transistor 24 electrically connected to the pixel electrode 25 are located, and the common electrode 26 is electrically insulated from the pixel electrode 25 and the film layer by a second insulating layer 272. Additionally as shown in FIG. 5A, the gate electrode 241 is covered by a first insulating layer 271; an active layer 244 is located on the first insulating layer 271; the source electrode 242 and drain electrode 243 are arranged on two lateral sides of the active layer 244 and are both electrically connected to the active layer 244; the source electrode 242, the drain electrode 243, and the active layer 244 are insulated from the gate electrode 241 via the first insulating layer 271, the drain electrode 243 is electrically connected to the pixel electrode 25, and the common electrode 26 is insulated from the pixel electrode 25 via a third insulating layer 273.

In the same row of pixel units 23, the pixel electrode 25, which is electrically connected to the thin film transistor 24 of a pixel unit adjacently disposed at the first side of the pixel electrode 25, partly overlaps the data line adjacently located at the first side of the pixel electrode 25; or in the same row of pixel units 23, the pixel electrode 25, which is electrically connected to the thin film transistor 24 of a pixel unit adjacently disposed at the second side of the pixel electrode 25, partly overlaps the data line 21 adjacently located at the second side of the pixel electrode 25. The electric signal affection will be generated at the overlapped area during working. Therefore, the common electrode 26 is arranged between the source electrode 242 and drain electrode 243 of the thin film transistor 24 such that the common electrode 26 has a function on shielding the electric signal at the overlapped area.

In embodiments of the pixel structure described above, the pixel electrode 25 has a structure including slits, while the common electrode employs a whole planar structure. However, in other embodiments of the pixel structure, the common electrode may also employ a structure including slits, while the pixel electrode employs the whole planar structure within the pixel unit. In this case, referring to FIG. 5B, the common electrode 26 may be arranged on the pixel electrode 25 and insulated from the pixel electrode 25 via the third insulating layer 273.

Figure 5B:
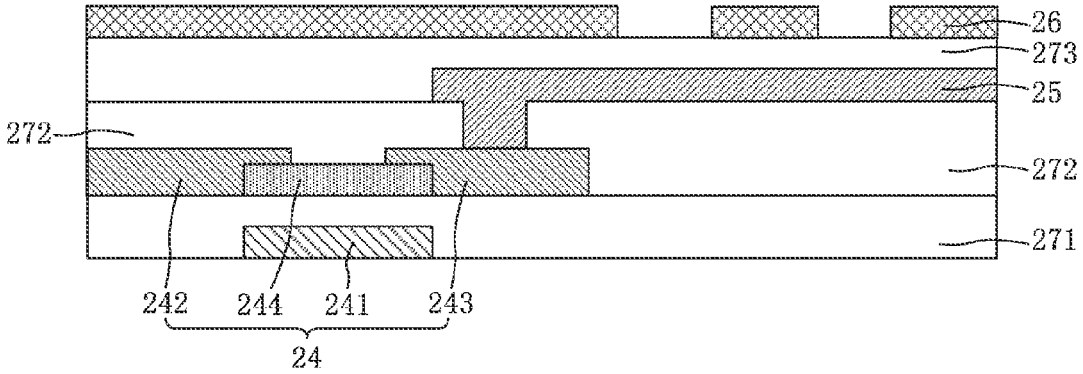
FIG. 5B is a schematic diagram of the structure of yet another pixel structure, according to embodiments of the disclosure.

It should be noted that, a specific example of the arrangement of the gate electrode 241 as shown in FIGS. 5A and 5B is exemplary, where the gate electrode 241 of the thin film transistor 24 is arranged below the source electrode 242 and drain electrode 243. However, in other examples, the gate electrode 241 may alternatively be arranged above the source electrode 242 and drain electrode 243, the arrangement manner of which is not limited herein.

Figure 6:
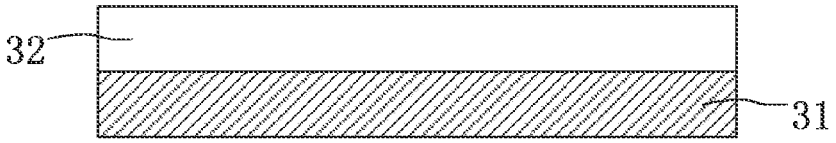
FIG. 6 is a schematic diagram of the structure of an array substrate, according to embodiments of the disclosure.

Embodiments of the disclosure provide an array substrate. FIG. 6 is a schematic diagram of the structure of the array substrate according to the embodiment of the present disclosure. Referring to FIG. 6, the array substrate includes a glass substrate 31 and a pixel structure 32 which may be the pixel structure according to the above embodiments.

Figure 7:
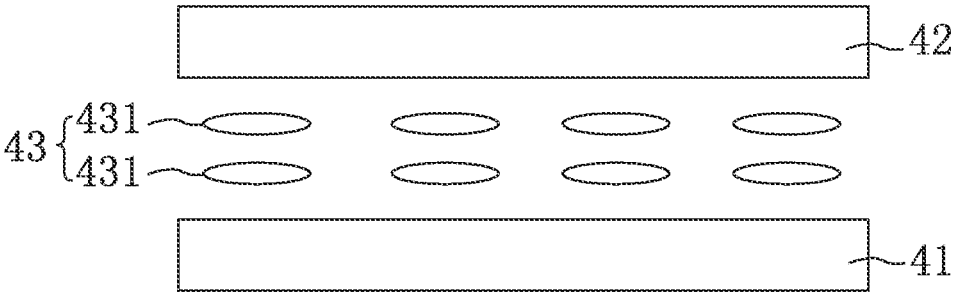
FIG. 7 is a schematic diagram of the structure of a display panel, according to embodiments of the disclosure.

Embodiment of the disclosure provide a display panel. FIG. 7 is a schematic diagram of the structure of a display panel according to embodiments of the disclosure. Referring to FIG. 7, the display panel includes an array substrate 41, a color filter substrate 42 disposed opposite to the array substrate 41, and a liquid crystal layer 43 located between the array substrate 41 and the color filter substrate 42. The liquid crystal layer 43 is formed of liquid crystal molecules 431. The array substrate 41 may be the array substrate according to the above embodiments.

It should be noted that the above display panel may have or not have a touch sensing function, depending on requirements in manufacturing. The touch sensing function may be an electromagnetic touch sensing function, a capacitive touch sensing function or an electromagnetism and capacitance integrated touch sensing function.

Figure 8:
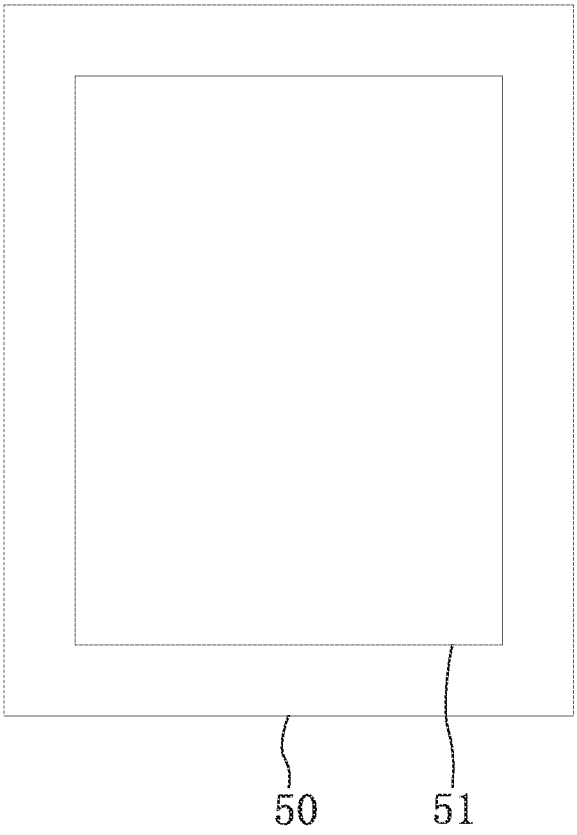
FIG. 8 is a schematic diagram of the structure of a display device, according to embodiments of the disclosure.

Embodiments of the disclosure provide a display device 50. FIG. 8 is a schematic diagram of the structure of a display device 50. Referring to FIG. 8, the display device 50 includes a display panel 51, and further includes a driving circuit and other devices for supporting a normal operation of the display device 50. The display panel 51 is the display panel according to the above embodiments. The display device 50 may be one of a cellphone, a laptop computer, a notebook, a tablet computer and an electronic paper.

Figure 9:
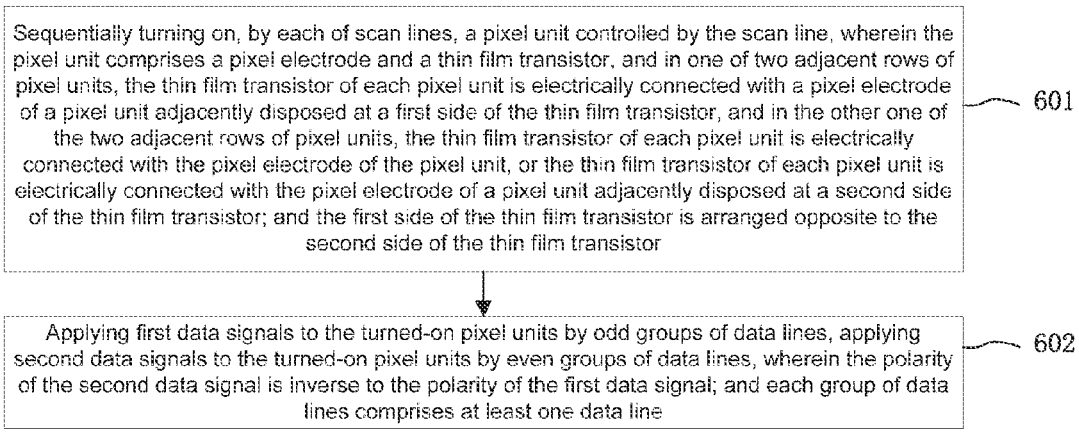
FIG. 9 is schematic flowchart of a driving method of the display device, according to embodiments of the disclosure.

Embodiments of the disclosure provide a driving method of the display device, which is implemented by the display device according to the above embodiments. FIG. 9 is a schematic flowchart of the driving method of a display device, according to embodiments of the disclosure. Referring to FIG. 9, the driving method of the display device includes the following Steps 601 to 602.

At Step 601, each of the scan lines sequentially turns on a pixel unit controlled by the scan line, where the pixel unit includes a pixel electrode and a thin film transistor, and in one of two adjacent rows of pixel units, the thin film transistor of each pixel unit in a column is electrically connected to a pixel electrode of a pixel unit adjacently located at a first side of the thin film transistor, and in the other one of the two adjacent rows of pixel units, the thin film transistor of each pixel unit is electrically connected to the pixel electrode of the pixel unit, or the thin film transistor of each pixel unit in a column is electrically connected to the pixel electrode of a pixel unit adjacently located at a second side of the thin film transistor; and an adjacent column at the first side of the thin film transistor is arranged opposite to an adjacent column at the second side of the thin film transistor.

At Step 602, first data signals are applied to the turned-on pixel units by odd groups of data lines, second data signals are applied to the turned-on pixel units by even groups of data lines, where the polarity of the second data signal is inverse to the polarity of the first data signal; and each group of data lines comprises at least one data line.

It should be noted that the polarity of the data signal is determined by the voltage difference between the voltages of the data signal and the common voltage. If the voltage difference is greater than "0", the polarity of the data signal is positive and usually indicated by "+"; and if the voltage difference is less than "0", the polarity of the data signal is negative and usually indicated by "−". Therefore, the fact that the polarity of a second data signal is inverse to the polarity of a first data signal, specifically means that: when the polarity of the first data signal is positive, the polarity of the second data signal is negative; or when the polarity of the first data signal is negative, the polarity of the second data signal is positive.

In some embodiments of the disclosure, each group of data lines includes one data line or two data lines.

Since, in the driving method of the display device, according to embodiments of the disclosure, the display device employs the pixel structure according to the above embodiments, the dot inversion can be achieved by the row inversion (corresponding to the case that each group of data lines includes one data line) or the two-dot inversion can be achieved by two-column inversion (corresponding to the case that each group of data lines includes two data lines), within a frame of image by driving the display device through Steps 601 to 602. Next, illustratively, the dot inversion is achieved by the row inversion within a frame of image by driving the display device through the above Steps 601 to 602. The description for the case that the two-dot inversion is achieved by the two-column inversion within a frame of image by driving the display device through the above Steps 601 to 602 can be referred to the description for the case that the dot inversion is achieved by the column inversion, or can be referred to the description for the related principle with respect to the above pixel structure in which the two-dot inversion is achieved by the two-column inversion, which will not be described repeatedly herein.

The pixel structure shown in FIG. 2A, for example, is used to further explain the principle used to implement the dot inversion by the column inversion in the display device driven through the Steps 601 to 602. Provided that the pixel unit includes seven columns of data lines and seven rows of scan lines, the driving method includes Steps one to three as below.

At Step one, the pixel units controlled by the first row of scan line are turned on, and a first data signal with a negative polarity "−" is applied to the turned-on pixel units by, odd columns of data lines and a second data signal with a positive polarity "+" is applied to the turned-on pixel units by even columns of data lines.

Figure 10A:
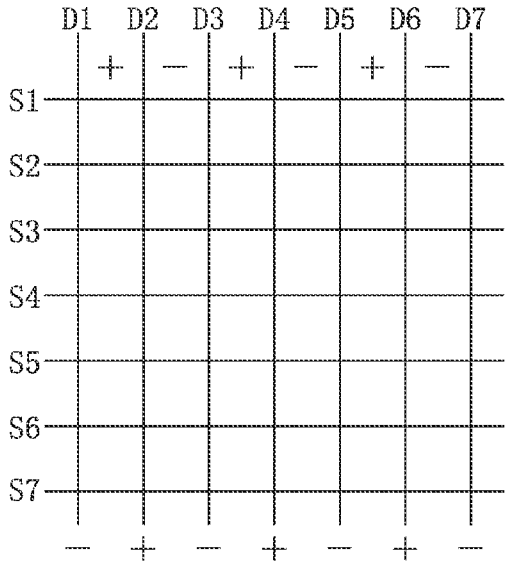

Referring to FIG. 10A, the first row of scan line 51 turns on the pixel units controlled by the first row of scan lines 51, and then the first data signal with a negative polarity "−" is applied to the turned-on pixel units by the odd columns of data lines D1, D3, D5 and D7, and the second data signal with a positive polarity "+" is applied to the turned-on pixel units by the even columns of data lines D2, D4 and D6. As shown in FIG. 2A, since in a row of pixel units, a pixel electrode of each pixel unit in a column is electrically connected to a thin film transistor of a pixel unit adjacently located at the left side of the pixel unit, and the thin film transistor is electrically connected to the data line adjacently located at the left side of said thin film transistor, the data signal with a positive polarity "+" and the data signal with a negative polarity "−" are sequentially and alternately obtained from the left side to the right side by the pixel units from the first row of pixel units after applying the first data signal and the second data signal to the pixel units from the first row of pixel units, as shown in FIG. 10A.

At Step two, the pixel units turned on by the first row of the scan lines are turned off, and then the pixel units controlled by a second row of scan lines are turned on by the second row of scan lines, and a first data signal with polarity of "−" is applied to the turned-on pixel units by odd columns of data lines, and a second data signal with polarity of "+" is applied to the turned-on pixel units by even columns of data lines.

Referring to 10B, the pixel units turned on by the first row of scan line 51 are turned off, the pixel units controlled by the second row of scan line S2 are turned on by the second row of scan line S2, and then the first data signal with a negative polarity "−" is applied to the turned-on pixel units by the odd columns of data lines D1, D3, D3 and D7, and the second data signal with a positive polarity "+" is applied to the turned-on pixel units by the even columns of data lines D2, D4 and D6. As shown in FIG. 2A, in a row of pixel units, since in a row of pixel units, a pixel electrode of each pixel unit in a column is electrically connected to the thin film transistor of the pixel unit, and the thin film transistor is electrically connected to the data line adjacently located at the left side of said thin film transistor, the data signal with polarity of "+" and the data signal with polarity of "−" are sequentially and alternately obtained from the left side to the right side by the pixel units from the second row of pixel units after applying the first data signal and the second data signal to the pixel units from the second row of pixel units, as shown in FIG. 10B.

At Step three, the pixel units turned on by the second row of scan line are turned off, and then the pixel units controlled by a third row of scan lines are turned on by the third row of scan lines, and the first data signal with a negative polarity "−" is applied to the turned-on pixel units by the odd columns of data lines, and the second data signal with a positive polarity "+" is applied to the turned-on pixel units by the even columns of data lines, and so on, until the remaining rows of scan lines are processed in the above manner.

Referring to FIG. 10C, the pixel units turned on by the second row of scan line S2 are turned off, and then the pixel units controlled by a third row of scan lines S3 are turned on by the third row of scan lines S3, and the first data signal with a negative polarity "−" is applied to the turned-on pixel units by the odd columns of data lines D1, D3, D5 and D7, and the second data signal with a positive polarity "+" is applied to the turned-on pixel units by the even columns of data lines D2, D4 and D6, and so on, until the remaining rows of scan lines S4 to S7 are processed in the above manner. Among the remaining pixel units, the polarity of the data signal applied to the odd rows of pixel units is the same as the polarity of data signal applied to the first row of pixel units, and can be referred to the related description in Step one; and the polarity of the data signal applied to the even rows of pixel units is the same as the polarity of data signal applied to the second row of pixel units, and can be referred to the related description in Step two. Additionally, FIG. 10C shows the polarity of the data signal applied to each of the pixel units within one frame of image. As can be seen from FIG. 10C, in the display device employing the pixel structure shown in FIG. 2A, the dot inversion can be implemented by the column inversion via Steps one to three.

In some embodiments, an amplitude value of the polarity of the first data signal (i.e. an absolute value of a voltage difference between the voltage of the first data signal and the common voltage) is the same as the amplitude value of the polarity of the second data signal (i.e. an absolute value of a voltage difference between the voltage of the second data signal and the common voltage). For example, if the voltage of the first data signal is 10V and the common voltage is 6V, the voltage of the second data signal should be 2V, so that the voltage difference between the voltage of the first data signal and the common voltage is 4V, and the voltage difference between the voltage of the second data signal and the common voltage is −4V. Therefore, the polarity of the first data signal is inverse to the polarity of the second data signal, and the amplitude value of the polarity of the first data signal is the same as the amplitude value of the polarity of the second data signal.

In some embodiments, the driving method of the display device is preferably carried out in a polarity inversion driving period including two frames of images. FIG. 11A shows the polarity distribution of the data signals when the display device implements the dot inversion by the row inversion in displaying the first frame of image. FIG. 11B shows the polarity distribution of the data signals when the display device implements the dot inversion by the row inversion in displaying the second frame of image. It can be seen from FIGS. 11A and 11B that the polarity of each dot (corresponding to one pixel unit) in displaying the first frame of image is inverse to the polarity of the same dot in displaying the second frame of image, that is, the polarity of the data signal in displaying the second frame of image is inverted as compared with that in displaying the first frame of image, meaning that the driving method of the display device is carried out in a polarity inversion driving period including two frames of images.

In addition to a polarity inversion driving period including two frames of images, the driving method of the display device can be carried out in a polarity inversion driving period including four frames of images or a larger even number of frames of images. For example, FIGS. 12A to 12D show that the driving method of the display device is carried out in a polarity inversion driving period including four frames of images. However, it can be seen from FIGS. 11A, 11B, and 12A to 12D that, if the driving method of the display device is carried out in a polarity inversion driving period including two frames of images, the polarity inversion frequency is increased, thereby reducing the possibility of permanent damage to the liquid crystal material caused by polarization of the liquid crystal material, so as to better protect the liquid crystal material.

According to the pixel structure, array substrate, display panel, display device, and driving methods of the display device described above, in one of two adjacent rows of pixel units, the thin film transistor of each pixel unit is electrically connected to the pixel electrode of a pixel unit adjacently located at a first side of the thin film transistor; and in the other one of the two adjacent rows of pixel units, the thin film transistor of each pixel unit is electrically connected to the pixel electrode of the pixel unit, or the thin film transistor of each pixel unit in a column is electrically connected to the pixel electrode of a pixel unit adjacently located at a second side of the thin film transistor, thus the pixel structure can achieve a dot inversion by a column inversion or can achieve two dot inversion by double-column inversion, thereby ensuring the small power consumption of the polarity inversion. Also, even if the source electrode and drain electrode are not precisely aligned with the gate electrode during manufacturing the thin film transistor, the lowered degree of the voltage of the pixel electrodes of the odd rows are the same as that of the pixel electrodes of the even rows when the scan signals applied by the scan lines are lowered, accordingly, the compensate voltage of the common electrode required by the pixel electrodes of the odd rows is equal to that required by the pixel electrodes of the even rows, namely the common electrode can completely compensate the voltage of the pixel electrodes of the odd rows and the even rows, so that the stripes or flicker generated because the common electrode cannot completely compensate the voltage of the pixel electrode of the odd rows and the even rows can be avoided, and thus improving the display effect of the pixel structure.

It should be understood for those skilled in the art that the present disclosure is not limited to particular embodiments described herein. Various apparent changes, readjustment and alternative can be made by those skilled in the art without departing from the scope of the disclosure. Therefore, although the disclosure is illustrated in detail through the above embodiments, the disclosure is not limited to the above embodiments, and can further include more of other equivalent embodiments without departing from the present disclosure.

Various modifications and additions can be made to the exemplary embodiments discussed without departing from the scope of the disclosure. For example, while the embodiments described above refer to particular features, the scope of this disclosure also includes embodiments having different combinations of features and embodiments that do not include all of the described features. Accordingly, the scope of the disclosure is intended to embrace all such alternatives, modifications, and variations as fall within the scope of the claims, together with all equivalents thereof.

We claim:

1. A display panel, comprising a pixel structure, the pixel structure comprising:

a plurality of data lines and a plurality of scan lines;

a plurality of pixel units formed by intersecting the plurality of data lines with the plurality of scan lines, wherein a pixel unit corresponds to one of the plurality of data lines and one of the plurality of scan lines and each of the pixel units comprises a pixel electrode and a thin film transistor therein;

wherein in one of two adjacent rows of pixel units, a thin film transistor of a pixel unit in a row is electrically connected to a pixel electrode of a pixel unit in the same row adjacently disposed at a first side of the pixel unit comprising the thin film transistor and in the other one of the two adjacent rows of pixel units, a thin film transistor of a pixel unit in a row is electrically connected to a pixel electrode of the pixel unit, or the thin film transistor of the pixel unit in the row is electrically connected to a pixel electrode of a pixel unit in the same row adjacently disposed at a second side of the pixel unit comprising the thin film transistor; and the first side of the thin film transistor is arranged opposite to the second side of the thin film transistor.

2. The display panel of claim 1, wherein:

in the odd rows of pixel units, a thin film transistor of a pixel unit in a row is electrically connected to a pixel electrode of a pixel unit in the same row adjacently disposed at the first side of the pixel unit comprising the thin film transistor and in the even rows of pixel units, a thin film transistor of a pixel unit in a row is electrically connected to a pixel electrode of the pixel unit; or in the even rows of pixel units, a thin film transistor of a pixel unit in a row is electrically connected to a pixel electrode of a pixel unit in the same row adjacently disposed at the first side of the pixel unit comprising the thin film transistor and in the odd rows of pixel units, a thin film transistor of a pixel unit in a row is electrically connected to a pixel electrode of the pixel unit.

3. The display panel of claim 1, wherein:

in the odd rows of pixel units, a thin film transistor of a pixel unit in a row is electrically connected to a pixel electrode of a pixel unit in the same row adjacently disposed at the first side of the pixel unit comprising the thin film transistor and in the even rows of pixel units, a thin film transistor of a pixel unit in a row is electrically connected to a pixel electrode of a pixel unit in the same row adjacently disposed at the second side of the pixel unit comprising the thin film transistor; or in the even rows of pixel units, a thin film transistor of a pixel unit in a row is electrically connected to a pixel electrode of a pixel unit in the same row adjacently disposed at the first side of the pixel unit comprising the thin film transistor and in the odd rows of pixel units, a thin film transistor of a pixel unit is electrically connected to a pixel electrode of a pixel unit in the same row adjacently disposed at the second side of the pixel unit comprising the thin film transistor.

4. The display panel of claim 3, wherein:

in the same row of pixel units, the pixel electrode of a pixel unit, which is electrically connected to the thin film transistor of a pixel unit adjacently disposed at the first side of the pixel unit comprising the pixel electrode, partly overlaps the data line adjacently located at the first side of the pixel unit comprising the pixel electrode; or in the same row of pixel units, the pixel electrode of a pixel unit, which is electrically connected to the thin film transistor of a pixel unit adjacently disposed at the second side of the pixel unit comprising the pixel electrode, partly overlaps the data line adjacently located at the second side of the pixel unit comprising the pixel electrode.

5. The display panel of claim 1, wherein:

in the same row of pixel units, the pixel electrode of a pixel unit, which is electrically connected to the thin film transistor of a pixel unit adjacently disposed at the first side of the pixel unit comprising the pixel electrode, partly overlaps the data line adjacently located at the first side of the pixel unit comprising the pixel electrode; or in the same row of pixel units, the pixel electrode of a pixel unit, which is electrically connected to the thin film transistor of a pixel unit adjacently disposed at the second side of the pixel unit comprising the pixel electrode, partly overlaps the data line adjacently located at the second side of the pixel unit comprising the pixel electrode.

6. The display panel of claim 1, further comprising a common electrode located between the pixel electrode and a film layer where a source electrode and a drain electrode of the thin film transistor electrically connected to the pixel electrode are located, and the common electrode is insulated from the pixel electrode and the film layer.

7. The display panel of claim 1, wherein:

a source electrode of the thin film transistor is electrically connected to the data line corresponding to the pixel unit comprising the pixel electrode electrically connected to the thin film transistor; and a gate electrode of the thin film transistor is electrically connected to the scan line corresponding to the pixel unit comprising the pixel electrode electrically connected to the thin film transistor.

8. The display panel of claim 1, wherein the plurality of pixel units are arranged in a staggered manner or in a matrix.

9. A display device, comprising a display panel, wherein the display panel comprises a pixel structure, and the pixel structure comprises:

a plurality of data lines and a plurality of scan lines;

a plurality of pixel units formed by intersecting the plurality of data lines with the plurality of scan lines, wherein a pixel unit corresponds to one of the plurality of data lines and one of the plurality of scan lines and each of the pixel units comprises a pixel electrode and a thin film transistor therein;

wherein in one of two adjacent rows of pixel units, a thin film transistor of a pixel unit in a row is electrically connected to a pixel electrode of a pixel unit in the same row adjacently disposed at a first side of the pixel unit comprising the thin film transistor and in the other one of the two adjacent rows of pixel units, a thin film transistor of a pixel unit in a row is electrically connected to a pixel electrode of the pixel unit, or the thin film transistor of the pixel unit in the row is electrically connected to a pixel electrode of a pixel unit in the same row adjacently disposed at a second side of the pixel unit comprising the thin film transistor; and the first side of the thin film transistor is arranged opposite to the second side of the thin film transistor.

10. A driving method of a display device, which is performed by a display device, wherein the display device comprises a display panel comprising a pixel structure, the pixel structure comprises:

a plurality of data lines and a plurality of scan lines;

a plurality of pixel units formed by intersecting the plurality of data lines with the plurality of scan lines, wherein a pixel unit corresponds to one of the plurality of data lines and one of the plurality of scan lines and each of the pixel units comprises a pixel electrode and a thin film transistor therein;

wherein in one of two adjacent rows of pixel units, a thin film transistor of a pixel unit in a row is electrically connected to a pixel electrode of a pixel unit in the same row adjacently disposed at a first side of the pixel unit comprising the thin film transistor and in the other one of the two adjacent rows of pixel units, a thin film transistor of a pixel unit in a row is electrically connected to a pixel electrode of the pixel unit, or the thin film transistor of the pixel unit in the row is electrically connected to a pixel electrode of a pixel unit in the same row adjacently disposed at a second side of the pixel unit comprising the thin film transistor; and the first side of the thin film transistor is arranged opposite to the second side of the thin film transistor, the driving method comprising:

pixel units controlled by each scan line are sequentially turned on by the corresponding scan lines, wherein the pixel unit comprises a pixel electrode and a thin film transistor, and in one of two adjacent rows of pixel units, a thin film transistor of a pixel unit in a row is electrically connected to a pixel electrode of a pixel unit in the same row adjacently disposed at a first side of the pixel unit comprising the thin film transistor, and in the other one of the two adjacent rows of pixel units, a thin film transistor of a pixel unit in a row is electrically connected to a pixel electrode of the pixel unit, or a thin film transistor of a pixel unit in a row is electrically connected to a pixel electrode of a pixel unit in the same row adjacently disposed at a second side of the pixel unit comprising the thin film transistor; and the first side of the thin film transistor is arranged opposite to the second side of the thin film transistor; and applying first data signals to the turned-on pixel units by odd groups of data lines, applying second data signals to the turned-on pixel units by even groups of data lines, wherein the polarity of the second data signal is inverse to the polarity of the first data signal; and each group of data lines comprises at least one data line.

11. The driving method of claim 10, wherein each group of data lines comprises one data line or two data lines.

12. The driving method of claim 10, wherein an amplitude value of the polarity of the first data signal is same as that of the second data signal.

13. The driving method of claim 10, wherein the method is performed in a polarity inversion driving period including two frames of images.

* * * * *